US007193580B2

(12) United States Patent
Deng et al.

(10) Patent No.: US 7,193,580 B2
(45) Date of Patent: Mar. 20, 2007

(54) ANTENNA DEVICE

(75) Inventors: Ten-Long Deng, ZhuDng Township, Hsinchu County (TW); Hsiao-Ming Tsai, Taipei (TW)

(73) Assignee: Asustek Computer Inc., Taipei (TW)

( * ) Notice: Subject to any disclaimer, the term of this patent is extended or adjusted under 35 U.S.C. 154(b) by 20 days.

(21) Appl. No.: 11/147,890

(22) Filed: Jun. 8, 2005

(65) Prior Publication Data

US 2006/0017645 A1 Jan. 26, 2006

(30) Foreign Application Priority Data

Jul. 23, 2004 (CN) ..... 93 1 22019

(51) Int. Cl.
*H01Q 1/52* (2006.01)

(52) U.S. Cl. ..... 343/841; 343/702; 343/872

(58) Field of Classification Search ..... 343/702, 343/841, 851, 846, 872
See application file for complete search history.

(56) References Cited

U.S. PATENT DOCUMENTS 4,975,711 A 12/1990 Lee ..... 343/702
5,394,160 A * 2/1995 Iwasaki et al. ..... 343/702
6,014,113 A * 1/2000 Orchard et al. ..... 343/841
6,392,603 B1 5/2002 Kurz et al. ..... 343/702
6,946,996 B2 * 9/2005 Koyama ..... 343/700 MS
2004/0082309 A1 4/2004 Smith ..... 455/344

FOREIGN PATENT DOCUMENTS

EP 1445825 A2 8/2004
JP 06260949 9/1994

* cited by examiner

*Primary Examiner*—Hoang V. Nguyen
(74) *Attorney, Agent, or Firm*—Thomas, Kayden, Horstemeyer & Risley

(57) ABSTRACT

An antenna device. The antenna device includes a printed circuit board, a conductive shield, a first connection portion and a second connection portion. The printed circuit board has a feed point and a ground plane insulated from the feed point. The conductive shield surrounds the printed circuit board. The first connection portion is substantially perpendicular to the printed circuit board, electrically connecting the feed point and the conductive shield. The second connection portion is substantially perpendicular to the printed circuit board, electrically connecting the ground plane and the conductive shield.

7 Claims, 4 Drawing Sheets

ANTENNA DEVICE

BACKGROUND

The invention relates in general to an antenna device and in particular to an antenna device with improved reception.

Embedded antennas, such as chip antennas and planar antennas, are widely applied to wireless communication devices. One conventional chip antenna is a ceramic chip antenna produced by LTCC (Low Temperature Co-fired Ceramic) technology. Conventional planar antennas such as microstrip antennas, printed antennas and Planar Inverted F Antennas (PIFAs), are generally applied in GSM, DCS, UMTS, WLAN and bluetooth wireless equipment such as mobile phones and wireless LAN adapters.

Referring to FIGS. 1*a* and 1*b*, a conventional wireless communication device 10 with PIFA, such as a wireless LAN adapter, primarily comprises a plastic housing C and a printed circuit board 20 disposed therein. The housing C encloses the printed circuit board 20 with PIFA structure formed thereon for transmitting and receiving radio signals. As shown in FIG. 1*b*, the printed circuit board 20 features a conventional PIFA structure, comprising a substrate 200, a feed line 201, a short line 202, a longitudinal wire 203 and a ground G. The longitudinal wire 203 has an open end 2030 and a closed end 2031 connecting the short line 202. In FIG. 1*b*, the short line 202 connects the closed end 2031 with the ground G, and the feed line 201 is extended from the middle part of the longitudinal wire 203 to an external circuit (not shown). Particularly, the feed line 201 and the ground G are insulated, and the distance from the open end 2030 to the closed end 2031 is substantially equal to ¼ of a radio signal wavelength. As the PIFA structure including the feed line 201, short line 202, longitudinal wire 203 and ground G is formed on the substrate 200 surface, however, it is suitable for horizontally polarized radio waves but not preferable for receiving vertically polarized radio signals.

SUMMARY

Accordingly, embodiments of the invention provide an antenna device. The antenna device comprises a printed circuit board, a conductive shield, a first connection portion and a second connection portion. The printed circuit board comprises a feed point and a ground plane insulated from the feed point. The conductive shield surrounds the printed circuit board. The first connection portion is substantially perpendicular to the printed circuit board, electrically connecting the feed point and the conductive shield. The second connection portion is substantially perpendicular to the printed circuit board, electrically connecting the ground plane and the conductive shield.

BRIEF DESCRIPTION OF THE DRAWINGS

The invention will become more fully understood from the following detailed description and the accompanying drawings, given by way of illustration only and thus not intended to be limit the disclosure.

DETAILED DESCRIPTION

Figure 1A:
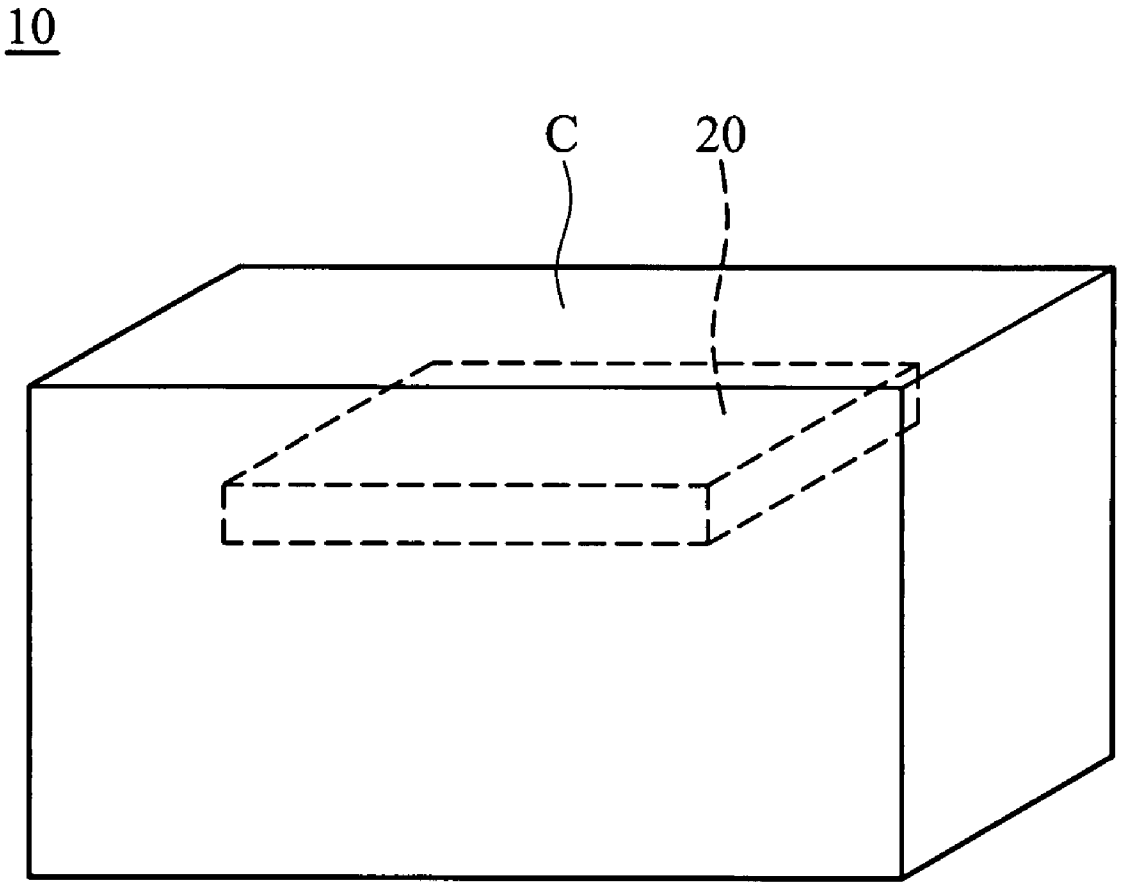
FIG. 1a ( RELATED ART )
FIG. 1*a* is a perspective diagram of a conventional wireless communication device provided with a PIFA therein.
Figure 1B:
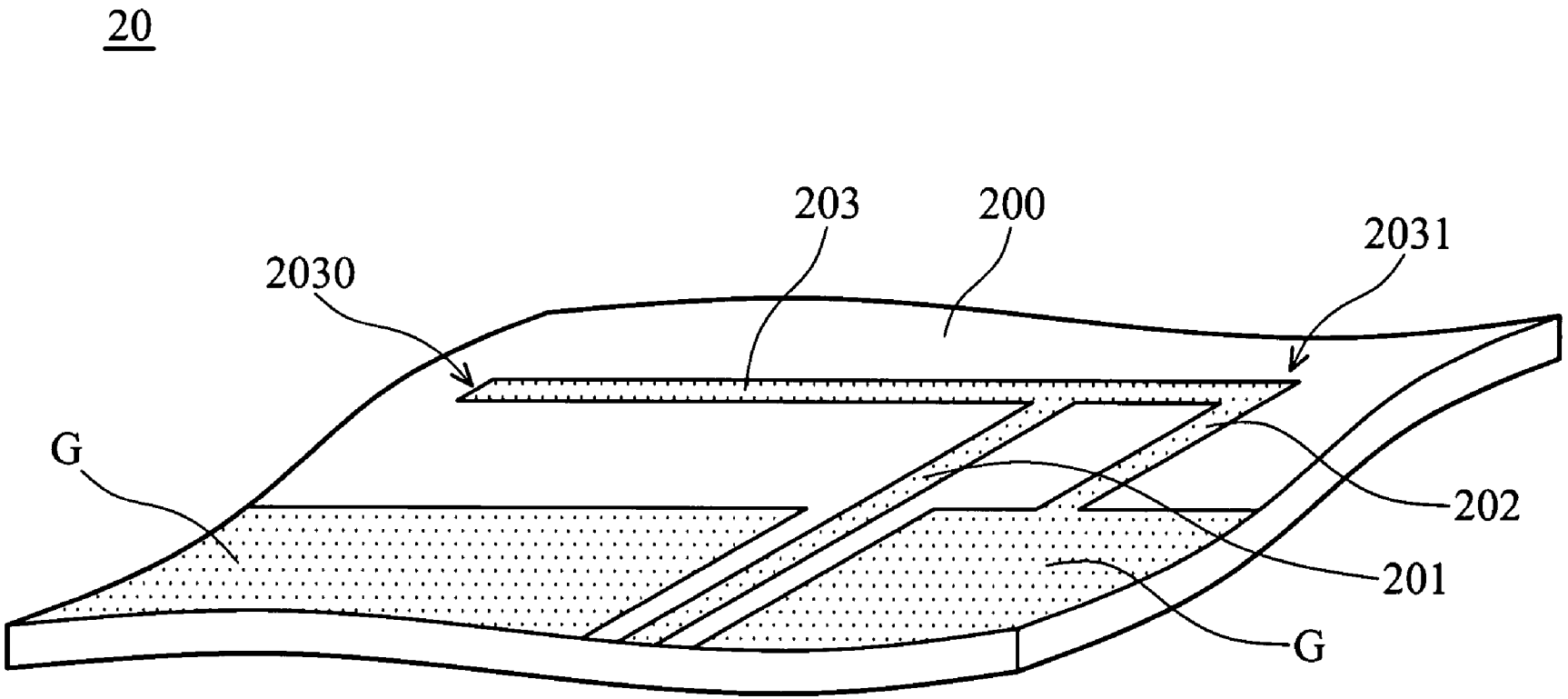
FIG. 1b ( RELATED ART )
FIG. 1*b* is a perspective diagram of a PIFA structure formed on the printed circuit board according to FIG. 1*a*.
Figure 2A:
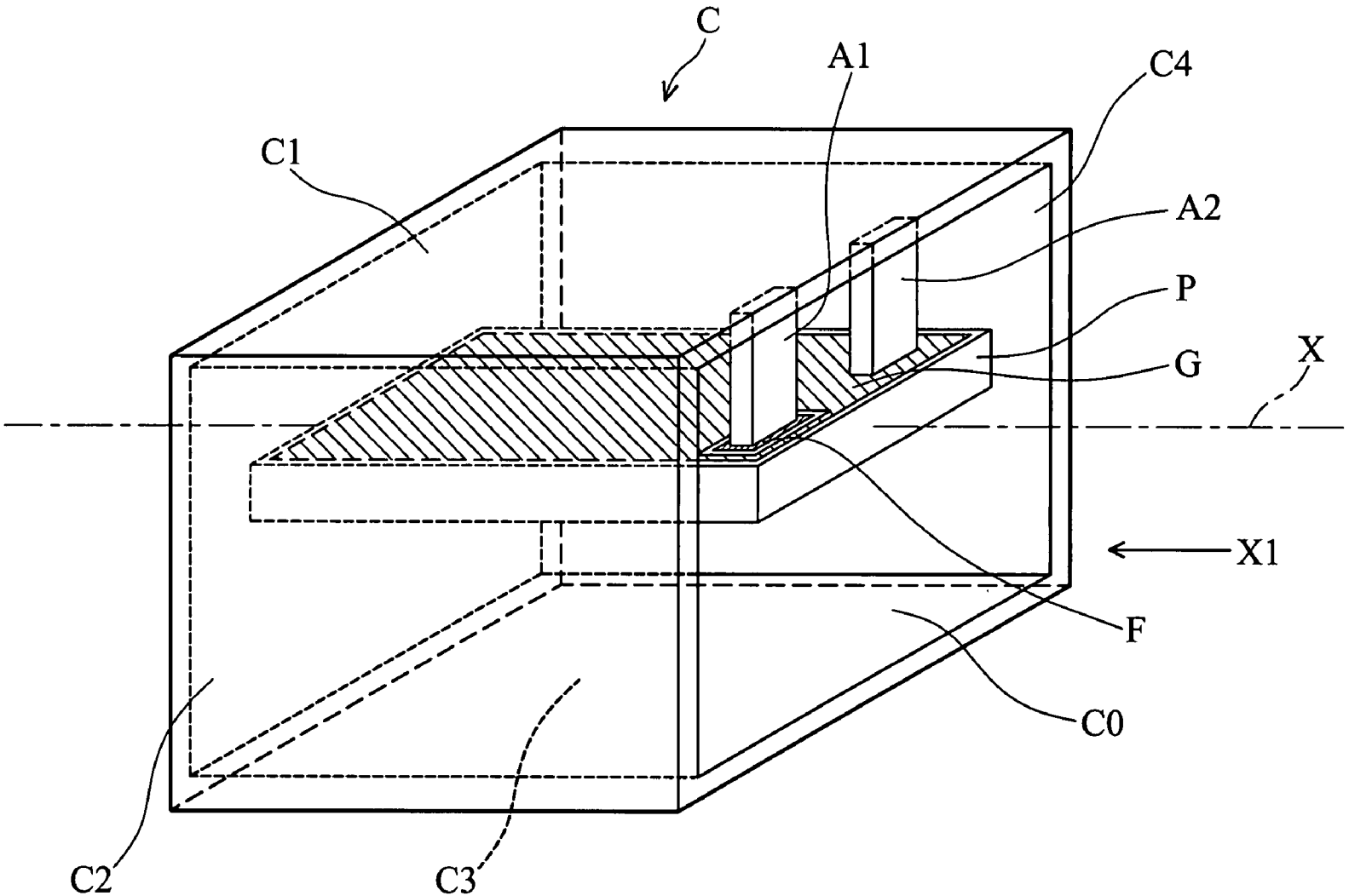
FIG. 2*a* is a perspective diagram of the antenna device of an embodiment of the invention.
Figure 2B:
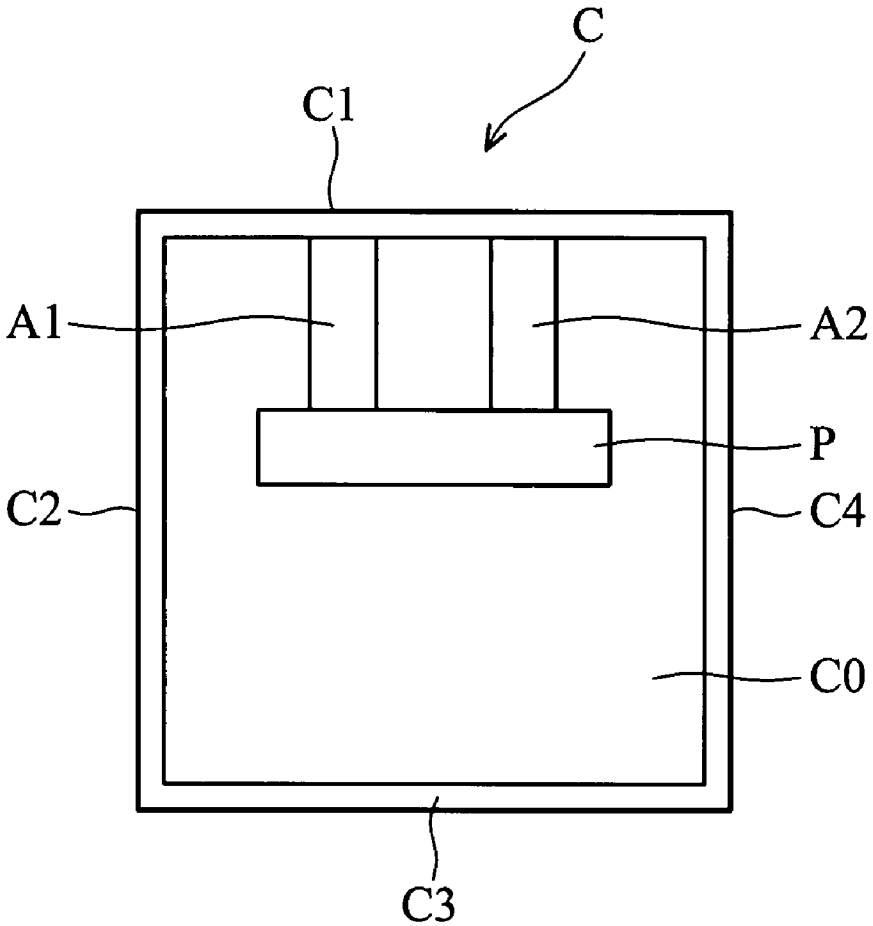
FIG. 2*b* is a side view of the antenna device in direction X1 according to FIG. 2*a*.

Referring to FIGS. 2*a* and 2*b*, the antenna device is applied to a wireless communication device, such as a mobile phone or a wireless LAN adapter, and primarily comprises a printed circuit board P, a metallic conductive shield C, a first connection portion A1 and a second connection portion A2. The printed circuit board P comprises signal processing circuits and radio communication circuits. As shown in FIG. 2*a*, the rectangular metallic conductive shield C is hollow and extends along a central axis X thereof, consisting of four conductive plates C1, C2, C3 and C4 surrounding the printed circuit board P. The hollow conductive shield C defines a rectangular opening C0 with the central axis X passing therethrough, and the printed circuit board P is disposed in the conductive shield C and parallel to the central axis X.

Specifically, the printed circuit board P of the antenna device is electrically connected with the conductive shield C by the longitudinal first and second connection portions A1 and A2, forming a 3-D antenna structure. As shown in FIGS. 2*a* and 2*b*, the longitudinal first and second connection portions A1 and A2 are disposed perpendicular to the printed circuit board P and the conductive plate C1. Particularly, the first connection portion A1 electrically connects a feed point F of the printed circuit board P, and the second connection portion A2 electrically connects a ground plane G of the printed circuit board P, wherein the feed point F and the ground plane G are insulated.

Referring to FIG. 2*b*, the first and second connection portions A1 and A2 are extended upward from the printed circuit board P to the conductive shield C forming a 3-D antenna structure, capable of receiving vertically polarized signal thereby providing omnidirectional communication. The length of the conductive shield C along X axis can be appropriately determined for receiving radio signals of specific frequency. Moreover, as the first and second connection portions A1 and A2 are erected perpendicular to the printed circuit board P, the reception efficiency for vertically polarized radio signals is thereby improved.

In summary, embodiments of the invention provide an antenna device facilitating the reception efficiency with respect to vertically polarized radio signals. Embodiments of the invention are suitable for application in wireless communication devices, such as mobile phones and wireless LAN adapters. The metallic conductive shield C not only has a specific metal texture, but also provides better structural strength than the conventional plastic housing.

While the invention has been described by way of example and in terms of preferred embodiments, it is to be understood that the invention is not limited thereto. To the contrary, it is intended to cover various modifications and similar arrangements (as would be apparent to those skilled in the art). Therefore, the scope of the appended claims should be accorded the broadest interpretation to encompass all such modifications and similar arrangements.

What is claimed is:

1. An antenna device, comprising:

a printed circuit board, comprising a feed point and a ground plane insulated from the feed point;

a conductive shield forming a rigid case surrounding the printed circuit board;

a first connection portion substantially perpendicular to the printed circuit board, electrically connecting the feed point and the conductive shield; and a second connection portion substantially perpendicular to the printed circuit board, electrically connecting the ground plane and the conductive shield.

2. The antenna device as claimed in claim 1, wherein the conductive shield is extended along a central axis thereof, comprising an opening with the central axis passing therethrough.

3. The antenna device as claimed in claim 2, wherein the printed circuit board is parallel to the central axis.

4. The antenna device as claimed in claim 2, wherein the first and second connection portions are perpendicular to the conductive shield.

5. The antenna device as claimed in claim 1, wherein the conductive shield comprises metal.

6. The antenna device as claimed in claim 1, wherein the opening is rectangular.

7. A wireless communication device, comprising:

a printed circuit board, comprising a feed point and a ground plane insulated from the feed point;

a conductive shield forming a rigid case surrounding the printed circuit board;

a first connection portion substantially perpendicular to the printed circuit board, electrically connecting the feed point and the conductive shield; and a second connection portion substantially perpendicular to the printed circuit board, electrically connecting the ground plane and the conductive shield.

* * * * *